United States Patent [19]

Jackson

[11] 3,970,027

[45] July 20, 1976

[54] PRIMING MEANS FOR BOW STEERING PUMPS

[76] Inventor: William M. Jackson, 109 Hursey Ave., Pass Christian, Miss. 39571

[22] Filed: Sept. 16, 1975

[21] Appl. No.: 613,742

[52] U.S. Cl. ..... 114/151; 115/12 R; 115/16; 417/199 A; 417/200

[51] Int. Cl.[2] ..... B63H 25/46

[58] Field of Search ..... 114/151, 148; 115/11, 115/12 R, 14, 16, 42; 60/221, 222; 417/199 R, 199 A, 200, 435

[56] References Cited

UNITED STATES PATENTS

| | | | |
|---|---|---|---|
| 1,445,507 | 2/1923 | Haentjens | 417/200 |
| 1,995,812 | 3/1935 | Noble | 417/200 |
| 3,590,766 | 7/1971 | Jackson | 114/151 |
| 3,874,316 | 4/1975 | Lorenz | 115/16 |

*Primary Examiner*—Stephen G. Kunin
*Assistant Examiner*—Charles E. Frankfort
*Attorney, Agent, or Firm*—Watson, Cole, Grindle & Watson

[57] ABSTRACT

In a bow steering unit for vessels including an axial flow pump having its suction and discharge nozzles intersecting with the hull of the vessel for selectively moving water in opposite directions to maneuver and steer the vessel in corresponding opposite directions, a device is provided for priming the blades of the pump with water during a light draft condition to the vessel and/or during travel of the vessel at a predetermined speed resulting in an under-priming of the blades. Such device comprises a vacuum pump installation communicating with the top portion of the pump through its casing for evacuating any air therein upon initial movement of the vessel and for overcoming the vacuum effect caused by the rapid passage of water past the nozzle openings, and further comprising a tube interconnecting a small hole in the bottom hull with such top portion of the pump so that the difference in negative pressure, during such rapid passage of water, at the larger nozzle openings and at the smaller hole causes water to inlet through the tube, with the assistance of the vacuum pump installation, to maintain the blades submerged and accordingly primed.

9 Claims, 6 Drawing Figures

FIG. 5
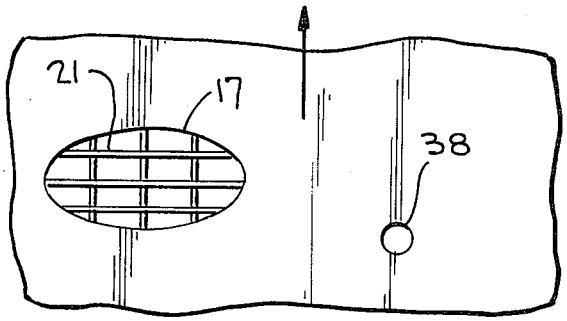
FIG. 6
FIG. 4
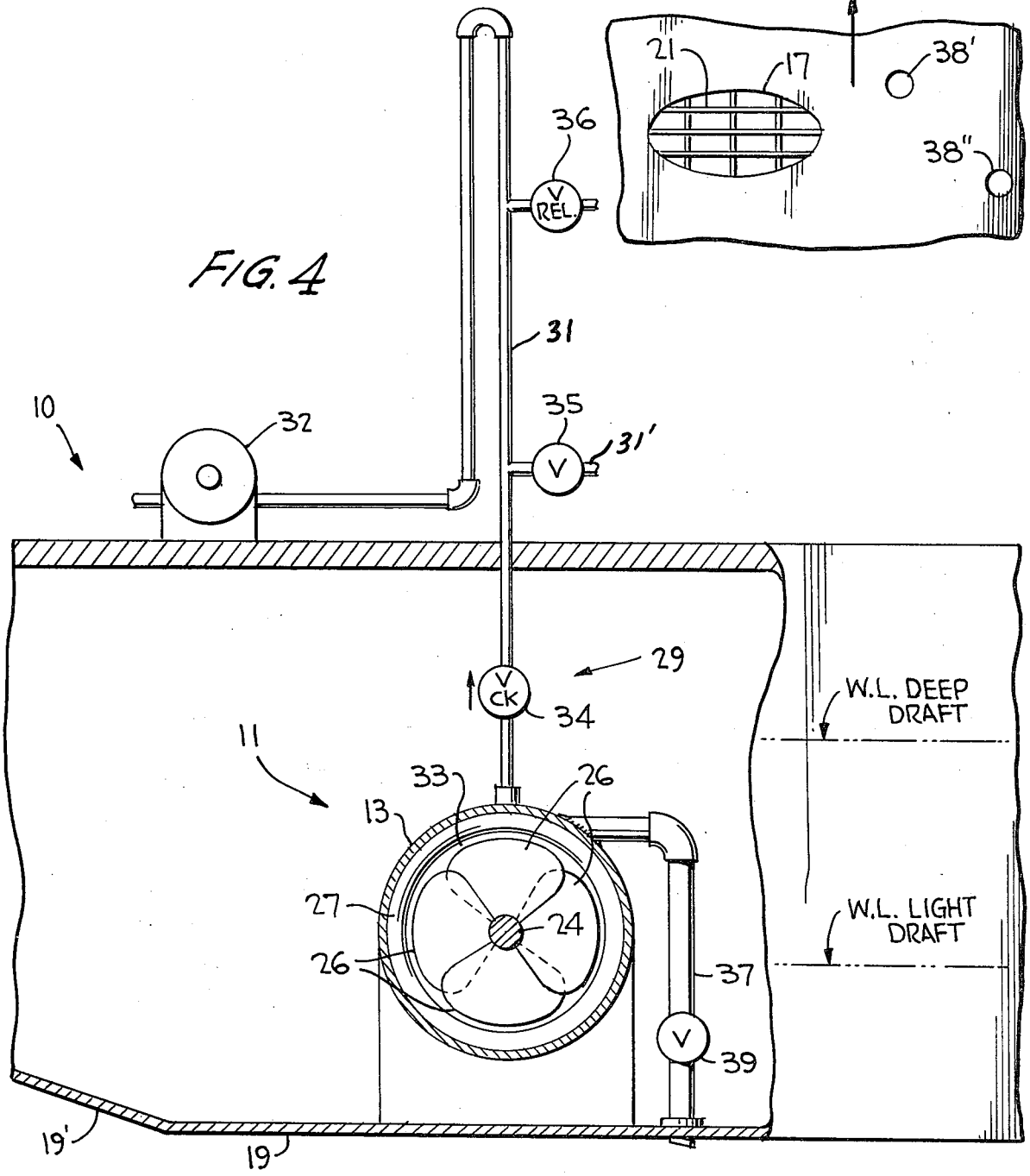

PRIMING MEANS FOR BOW STEERING PUMPS

BACKGROUND OF THE INVENTION

This invention relates generally to a steering unit for barges and other watercraft, more particularly to a means for priming the blades of an axial flow pump utilized for steering and maneuvering the watercraft.

In my prior U.S. Pat. No. 3,590,766, which adopts the axial flow pump principle set forth in my U.S. Pat. No. 2,847,941, a steering unit is disclosed for barges and the like as including a transversely extending casing having an axial flow pump therein for moving water through the casing in selectively opposite directions so as to steer and maneuver the barge in corresponding opposite directions. The casing has an intermediate portion connected with downwardly and outwardly extending end portions communicating with spaced openings in the bottom hull. A shroud structure surrounds the blades of the pump and has two axially juxtaposed, annular inwardly directed convex surfaces defining adjacent venturi sections with a common axis and an annular depression therebetween. Steering and maneuvering of barges with such a unit has proven quite successful except that it has been found difficult to prime the pump blades with water during initial movement of the barge or when under way particularly at high speeds during both a loaded or deep draft condition and during an unloaded or light draft condition. It should be noted that the waterline of the watercraft is normally above the top of the pump blades during a loaded or deep draft condition, and that the waterline of the watercraft is normally below the top of the pump blades during an unloaded or light draft condition.

As the craft moves through the water, a cushion of air moves along the bow rake until it reaches the nozzle openings as in my above-noted U.S. Pat. No. 3,590,766 whereupon it enters such openings thus displacing water in those areas as well as in the vicinity of the pump unit. As travel of the vessel continues, air build-up continues until enough water is displaced to cause a loss of priming in the vicinity of the pump blades. And, as the travel speed of the vessel increases, the increased velocity of the water moving across the nozzle openings causes an additional problem of negative pressure build-up across the nozzle openings thereby further complicating the free passage of water into the pump unit. The effectiveness of the steering unit is accordingly decreased.

The above conditions are apparent for a deep draft condition of the vessel and are even more amplified for a light draft condition with the waterline below the top of the pump blades creating an additional under-priming situation and the acceleration in vessel travel thereby compounding the problem of the negative pressure preventing free passage of water into the pump unit.

The under-priming problems as noted above are not limited to barges or the like wherein the inlet and outlet nozzles intersect with spaced openings provided in the bottom hull. Other types of watercraft have been designed with a transversely disposed water channel extending between openings provided in opposing side walls of the craft with the channel located entirely below the waterline of the craft. An axial flow pump disposed in the channel is designed to move water from one end thereof to the other for steering the vessel. Such an arrangement is disclosed in U.S. Pat. No. 3,874,316. However, under-priming problems similar to those noted above are presented for such an arrangement. The problem of overcoming the vacuum forces created by rapid movement of the water moving past the nozzle openings is likewise of concern for such a particular steering arrangement.

SUMMARY OF THE INVENTION

It is an object of this invention to provide a device communicating with the top portion of the pump through its casing of a steering unit for barges and other watercraft for priming the pump blades with water during both light and deep draft conditions of the craft and during travel of the craft at a predetermined speed resulting in an under-priming of the blades.

In carrying out this objective, such device comprises a vacuum means operable for evacuating any accumulation of air around the pump unit during a startup condition of the vessel, and for overcoming the vacuum effect caused by the rapid passage of water past the nozzle openings during travel of the vessel. Such a vacuum means is provided in combination with an inlet tube extending between the top portion of the pump and a small hole provided in the bottom hull so as to cause water to more rapidly enter the inlet tube for priming the pump blades as assisted by the vacuum means. The hole is of a substantially smaller size than that of the nozzle openings so as to assure an inletting of water through the tube by reason of the difference in negative pressure at the nozzle openings and at the hole caused by the passage of water thereover.

Other objects, advantages and novel features of the invention will become more apparent from the following detailed description of the invention when taken in conjunction with the accompanying drawings.

BRIEF DESCRIPTION OF DRAWINGS

FIG. 4 is a slightly enlarged sectional view taken substantially along line 4—4 of FIG. 1;

FIG. 5 is a bottom plan view taken substantially along line 5—5 of FIG. 1; and FIG. 6 is a bottom plan view taken substantially along line 6—6 of FIG. 2.

DESCRIPTION OF THE PREFERRED EMBODIMENT

Figure 1:
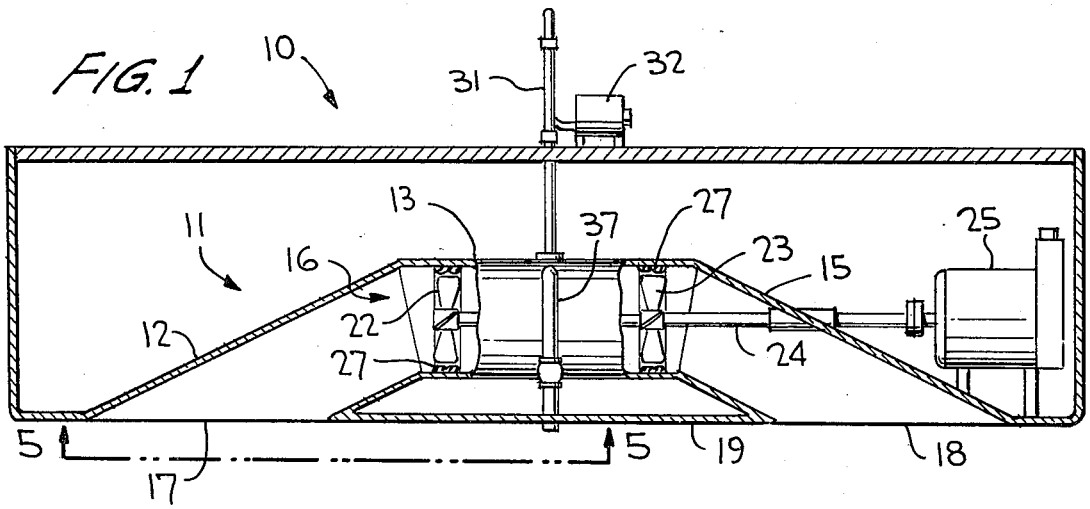
FIG. 1 is a sectional view in side elevation of a barge having a steering unit with a multi-stage pump incorporating the invention.
Figure 2:
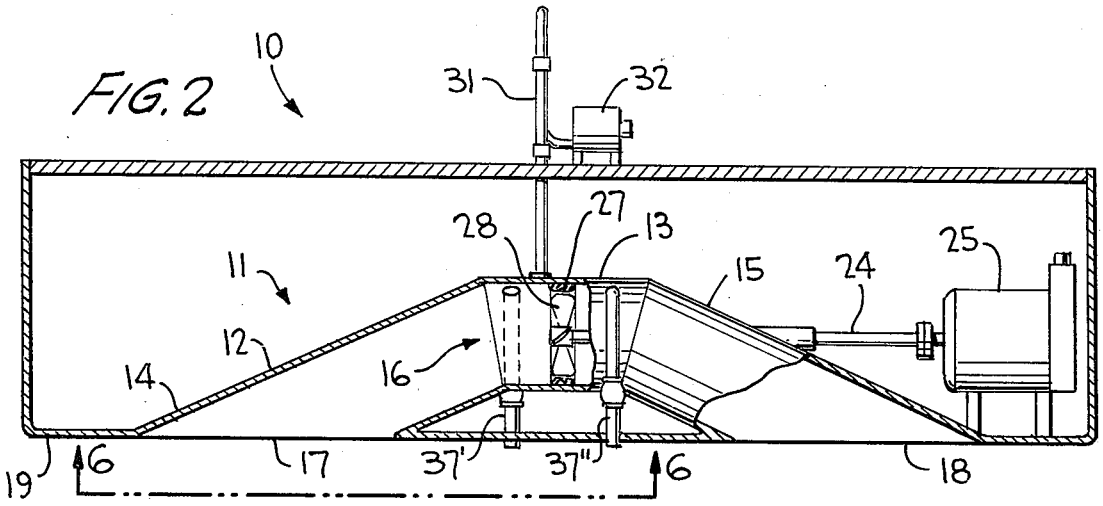
FIG. 2 is a view similar to FIG. 1 except that a single stage pump is shown in conjunction with the invention.

Turning now to the drawings wherein like reference characters refer to like and corresponding parts throughout the several views, a barge 10 is shown in FIG. 1 as having a steering unit 11 constructed similarly as in my prior U.S. Pat. No. 3,590,766. The steering unit generally comprises a transversely extending tube or casing 12 having an intermediate portion 13 connecting downwardly and outwardly extending end end portions 14 and 15. These end portions define nozzles for an axial flow pump 16 generally disposed within the intermediate portion of the tube. Also, the end portions or nozzles respectively communicate with nozzle openings 17 and 18 provided in bottom hull 19 of the barge. These nozzle openings are typically protected by gratings 21 as shown in FIGS. 5 and 6. Axial flow pump 16 generally comprises a pair of axially spaced propeller units 22 and 23 keyed to a shaft 24 which is rotatable by means of a power unit 25. Each propeller unit comprises a plurality of blades 26 (see FIG. 4) surrounded by a shroud structure 27 secured to the inner wall of intermediate tube portion 13. This shroud is identical to that disclosed in my U.S. Pat. No. 3,590,766 and functions in the same manner as disclosed therein. Hence, each shroud has two axially juxtaposed, and annular inwardly directed convex surfaces which define adjacent venturi sections with a common axis and an annular depression therebetween. Based on the description of the FIG. 1 embodiment so far, it can be seen that the barge steering unit is identical to such unit disclosed in my prior U.S. Pat. No. 3,590,766. Also, it should be noted that, although the FIG. 1 embodiment is shown as having a pair of axially spaced propeller units, more than two of such units may be provided if desired to form other types of multi-stage axial flow pumps. The FIG. 2 embodiment is the same as that shown in FIG. 1 except that a single stage axial flow pump is shown having a single propeller unit 28.

Referring to FIG. 4, a device generally designated 29 is shown for effecting a priming of the propeller blades within the casing so as to maintain the tips of the blades completely submerged in water for improved steering and maneuvering operations of the barge. Such a device comprises a barometric leg 31 defining a bent vacuum tube connected to a vacuum pump 32 mounted on the barge. This tube communicates with the top inner portion 33 at the pump unit through intermediate portion 13 as clearly shown in FIG. 4. A one-way check valve 34 is provided on leg 31 which opens when the pressure in line 31 within portion 13 exceeds the pressure in line 31 above valve 34. A vacuum relief valve 36 is also provided on the barometric leg, and a gate valve 35 is provided on a line 31′ open to the atmosphere and connected to leg 31, together with other elements (not shown) as is necessary to provide flexibility to the operating range of this vacuum installation.

The priming device further comprises an inlet tube 37 likewise communicating with top inner portion 33 and interconnecting this portion with a small hole 38 provided in bottom hull 19 of the barge. As shown in FIG. 5, the size of this small hole is substantially less than the size of either nozzle opening. A gate valve 39 is provided on inlet tube 37 for regulating the water flow therethrough. The valving disclosed for the pump priming device therefore includes gate or shutoff valves, a flapper valve for static pressure release and for holding against vacuum, and a pressure relief valve that can be either pre-set or controlled manually, electrically or pneumatically. Such a vacuum relief valve 36 is located near the highest elevation of the barometric leg.

Operation of the steering unit is the same as described in my U.S. Pat. No. 3,590,766. Hence, end portion 14 of the casing serves as a suction nozzle while end portion 15 serves as a discharge nozzle for the axial flow pump when its blades are rotated in a direction causing water flow from left to right as viewed in FIG. 1. The barge is correspondly moved to the left and, upon reverse rotation of the pump blades, end portion 15 becomes the suction nozzle and end portion 14 becomes the discharge nozzle so as to effect barge movement to the right when viewed in FIG. 1.

As the barge hull moves through the water in the direction of the arrows shown in FIGS. 5 and 6, a layer or cushion of air is conducted down the rake 19′ of the barge until it reaches nozzle openings 17 and 18 whereupon it enters through such openings and into downwardly extending tube portions 14 and 15 thus displacing water in these portions as well as in the intermediate tube portion containing the axial flow pump. As forward movement of the barge continues, air build-up continues until enough water is displaced to cause loss of priming of the pump blades. And, as the speed of the hull through the water increases, the increased velocity of the water across the nozzle openings creates another force, i.e., a vacuum is exerted at the nozzle openings thereby further complicating the free passage of water to the axial flow pump and resulting in the loss of effective steering ability. The above conditions are normally present for a loaded condition of the barge where its waterline is at a deep draft location as illustrated in FIG. 4. For a light draft waterline condition as also illustrated in this FIGURE, the factors noted above for a loaded barge condition are amplified because of the greater tendency for the pump blades to become under-primed with the waterline below the tops of the blades as shown. It is therefore necessary for the vacuum pump to be operated at all times, not only to evacuate any accumulated air within tube 12, but to overcome the vacuum pressure exerted at the nozzle openings during the increased velocity of the water moving across these openings.

For a loaded or deep draft condition of the barge, valve 39 remains open to permit free passage of water through inlet tube 37 and into intermediate portion 13. At slow speeds, valve 35 remains open to permit the accumulated air in the intermediate tube portion to escape through flapper valve 34 so as to be vented through valve 35 to the atmosphere. At high speeds the vacuum created by water passing over nozzle openings 17 and 18 results in valve 34 closed because of the increased negative pressure build-up across the nozzle openings. Valve 34 therefore closes due to the positive pressure in line 31 from open valve 35. The accumulated air is therefore not permitted to escape. Therefore, valve 35 must be closed and the vacuum pump must be operating thus forcing the evacuation of accumulated air through flapper valve 34. Water is therefore permitted to enter through inlet tube 37 to replace water evacuated from tube portion 13 by the dominant vacuum created by the rapid passage of water over the nozzle openings. In other words, the vacuum pump will function to equalize the negative pressure in portion 13 caused by rapid passage of water past the nozzle openings. Greater negative pressure across these openings may exceed the suction capability of pump 32. Therefore, the pump blades would remain under-primed without the use of tube 37. Inletting of water therethrough is made possible by the lesser vacuum force created by the water passing over the smaller area hole 38 for the inlet tube as compared to the greater vacuum force created by the water passing over the larger area nozzle openings.

It should be noted that only a single inlet tube 37 disposed between and adjacent the pair of propeller units of FIG. 1, or between adjacent pairs of more than two of such units in other types of multi-stage pumps, are necessary for the priming operation in accordance with the invention. Also, inlet tubes 37′ and 37″ disposed on opposite sides of a single stage pump as in FIG. 2 effect a good priming operation in accordance with the invention.

During a light draft condition of the barge, the vacuum pump must always be in operation to provide initial priming as well as to maintain pump priming at operating speeds. Therefore, valve 35 must be closed and all other valves remain open and operational as described above for a high speed operation of a loaded barge.

When underway, the vacuum pump is turned on to perform its function of overcoming the vacuum effect caused by the rapid passage of water past nozzle openings 17 and 18, and to more rapidly cause water to enter the inlet tube or tubes. The barometric leg should be designed to control the height that the water can be elevated by the vacuum created from the vacuum pump so as to prevent water from entering the vacuum pump and causing damage to the moving parts thereof. The leg can therefore be of any height necessary to achieve this purpose. A further and more precise control of this water height situation is accomplished by vacuum relief valve 36 which can be spring loaded or controlled by a solenoid actuator or even manually operated.

The principle function of the inlet tube or tubes is to permit water to replace accumulated and exhausted air in tube portion 13. This is accomplished by the lesser vacuum effect produced over the lesser area of hole 38 being overcome by the higher vacuum effect produced at the combined areas of nozzle openings 17 and 18 plus that produced by the vacuum pump. This difference is sufficiently large to assure a water supply through tube 37 into intermediate portion 13 of sufficient quantity to resist the loss of priming of the pump blades. Such an arrangement also serves as a pressure equalizer which reduces resistance to normal flow of water through tube 12 produced by the action in either direction of the rotating propellers therein.

Figure 3:
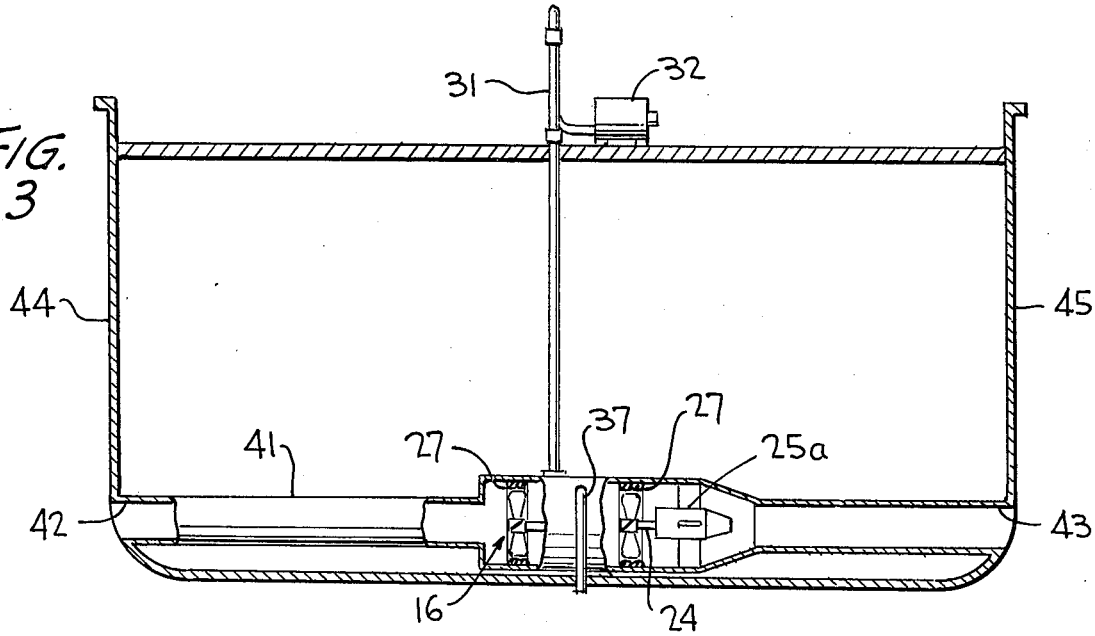
FIG. 3 is a sectional view in side elevation of a ship or like watercraft having a water channel for steering purposes and incorporating the invention.

FIG. 3 illustrates a steering unit having a water priming device installed for the steering of a ship or like watercraft and comprising a water channel 41 communicating with openings 42 and 43 in opposite side walls 44 and 45 of the craft. A multistage axial flow pump similar to that shown in FIG. 1 is disposed within the water channel and is powered by means of a power unit 25*a* located therein. The priming device including the vacuum means and the water inlet tube are likewise provided for this construction similar to that described in FIGS. 1 and 2. However, when the steering unit is installed in a ship, the waterline is normally always above openings 42 and 43 because the outwardly extending portions of the water channel do not extend downwardly as in the barge installations of FIGS. 1 and 2. Therefore, removal of accumulated air is less of a problem although the vacuum force created by the rapid movement of the water past openings 42 and 43 nevertheless persist. Hence, at slow speeds valve 35 is not necessary since there is no air to be evacuated. Flapper valve 34 nevertheless remains operational as a prevention of air intake for any reason, and pump 32 functions as before to equalize the pressure within the water channel as water rapidly passes over nozzle openings 42 and 43. Excess pressure build-up beyond the capacity of pump 32 nevertheless does not result in an under-priming of the pump blades since the pressure differential caused by the water passing over openings 42, 43 as compared to that passing over hole 38 (similar as in FIG. 5) allows water to pass into the channel through inlet 37.

From the foregoing, it can be seen that a simple and inexpensive yet highly effective pump priming device has been provided for charging the pump blades with water and maintaining them charged or primed during various loads and speed conditions of the watercraft. Such a means may be easily installed on barges constructed in accordance with my prior patent with a minimum of installation costs.

Obviously, many modifications and variations of the present invention are made possible in the light of the above teachings. It is therefore to be understood that within the scope of the appended claims the invention may be practiced otherwise than as specifically described.

What is claimed is:

1. In a bow steering unit for barges and the like having a bottom hull and a transversely extending casing defining first and second nozzles respectively communicating with spaced first and second openings in said bottom hull, an axial flow pump including at least one propeller unit disposed within a central portion of said casing between said nozzles for steering the vessel in one direction as water is inletted through said first nozzle and outletted through said second nozzle, and in an opposite direction as water is inletted through said second nozzle and outletted through said first nozzle, the improvement comprising a means for priming the blades of said propeller unit during various speeds and operating conditions of the vessel, said priming means comprising a vacuum tube interconnecting a vacuum pump with an upper area of said central portion, whereby any accumulation of air in said propeller unit caused during movement of the vessel may be evacuated and said blades accordingly maintained primed by permitting a sufficient amount of water to flow through one of said nozzles for effectively maintaining said blades submerged, said priming means further comprising at least one inlet tube communicating with a third opening in said hull bottom and extending through said upper area of said tube central portion for permitting water to inlet thereto during negative pressure build-up while water rapidly passes over said openings, said first and second openings each being of a predetermined size and said third opening being of a size substantially less than the size of said first and second openings, whereby the difference in the negative pressure at said first and second openings and at said third opening causes water to inlet through said inlet tube and into said casing to thereby maintain said blades submerged and accordingly primed.

2. The improvement according to claim 1, wherein said axial flow pump includes a pair of propeller units disposed within said central portion, said inlet tube being located between said units.

3. The improvement according to claim 1, wherein a pair of inlet tubes are disposed respectively on opposite sides of said propeller unit.

4. In a steering unit for barges and the like having a bottom wall and a transversely extending casing having an intermediate portion communicating with downwardly and outwardly extending end portions respectively communicating with openings in said bottom wall, an axial flow pump including at least one propeller unit operatively disposed in said casing, said propeller unit having radially extending blades rotatably mounted for conveying water through said casing in opposite directions for correspondingly steering the vessel in said directions, the improvement comprising a device associated with said casing for priming said blades with water during a light draft condition of the vessel and during travel of the vessel at a predetermined speed resulting in an under-priming of said blades, said device comprising vacuum means communicating with the interior of said casing for reducing the pressure around said blades so as to exceed the negative pressure in said casing created by rapidly moving water along said bottom wall over said openings, and said device further comprising at least one inlet tube interconnecting a top portion of said casing with a hole provided in said bottom wall, said openings each being of a size substantially greater than the size of said hole, and said tube being disposed adjacent said openings, whereby the difference in negative pressure at said openings and at said hole causes water to inlet through said tube for priming said blades during a negative pressure build-up in said casing which exceeds the capacity of said vacuum means.

5. The improvement according to claim 4, wherein said axial flow pump includes two propeller units, said tube being disposed between said units.

6. The improvement according to claim 4, wherein a pair of inlet tubes are disposed respectfully on opposite sides of said propeller unit.

7. In a steering unit for watercraft having a bottom wall and upwardly extending side walls, a transversely extending water channel disposed below the waterline thereof, said water channel interconnecting openings located in opposing ones of said side walls, an axial flow pump including at least one propeller unit operatively disposed in said channel, said propeller unit having radially extending blades rotatably mounted for conveying water through said channel in opposite directions for correspondingly steering the watercraft in said directions, the improvement comprising a device associated with said channel for priming said blades with water especially during travel of the watercraft at a predetermined speed resulting in an under-priming of said blades, said device comprising vacuum means communicating with the interior of said channel for reducing the pressure around said blades so as to exceed any negative pressure build-up along said side walls in the area of said openings, and said device further comprising at least one inlet tube interconnecting a top portion of said channel with a hole provided in said bottom wall, said openings each being of a size substantially greater than the size of said hole, whereby the difference in negative pressure at said openings and at said hole causes water to inlet through said tube for further maintaining said blades submerged and accordingly primed.

8. The improvement according to claim 7, wherein said axial flow pump includes two propeller units, said tube being disposed between said units.

9. The improvement according to claim 7, wherein a pair of inlet tubes are disposed respectively on opposite sides of said propeller unit.

* * * * *